US007178875B2

(12) United States Patent
Laske, Jr.

(10) Patent No.: US 7,178,875 B2
(45) Date of Patent: Feb. 20, 2007

(54) CHAIR APPARATUS

(76) Inventor: Lawrence L. Laske, Jr., 630 Fort Washington Ave., Apt. 5C, New York, NY (US) 10040

( * ) Notice: Subject to any disclaimer, the term of this patent is extended or adjusted under 35 U.S.C. 154(b) by 0 days.

(21) Appl. No.: 11/039,142

(22) Filed: Jan. 19, 2005

(65) Prior Publication Data

US 2005/0168044 A1 Aug. 4, 2005

Related U.S. Application Data

(60) Provisional application No. 60/538,253, filed on Jan. 20, 2004.

(51) Int. Cl.
*A47C 7/02* (2006.01)

(52) U.S. Cl. ..... 297/452.33; 297/DIG. 2

(58) Field of Classification Search ..... 297/463.2, 297/452.29, 352, 452.1, 188.04, 230.1, 219.1, 297/350, 351, 440.12, 377, DIG. 2, 452.33, 297/423.39; 248/545, 530–533, 156; 5/419
See application file for complete search history.

(56) References Cited

U.S. PATENT DOCUMENTS

| | | | | | |
|---|---|---|---|---|---|
| 1,312,774 | A * | 8/1919 | Barrett | 297/351 |
| 1,628,472 | A * | 5/1927 | Perry et al. | 297/351 |
| 2,108,531 | A * | 2/1938 | Flanders | 297/380 |
| 3,007,661 | A * | 11/1961 | Knopf | 248/545 |
| 3,675,363 | A * | 7/1972 | Mills | 446/109 |
| 4,421,318 | A * | 12/1983 | Sverdlik et al. | 473/476 |
| 4,586,207 | A * | 5/1986 | Cornette | 5/656 |
| 4,869,553 | A * | 9/1989 | Powell | 297/377 |
| 5,579,599 | A * | 12/1996 | Haeseler | 40/606.19 |
| 5,620,229 | A * | 4/1997 | Ledford | 297/229 |
| 6,908,067 | B2 * | 6/2005 | Clasen | 248/533 |

* cited by examiner

*Primary Examiner*—Milton Nelson, Jr.
(74) *Attorney, Agent, or Firm*—Pauley Petersen & Erickson

(57) ABSTRACT

A chair apparatus for supporting a back of a person. The chair apparatus has a backrest and at least one support member attached with respect to the backrest. Each support member extends away from the backrest and forms an implantable element which can be inserted into and beneath a ground surface, such as into sand or dirt.

20 Claims, 20 Drawing Sheets

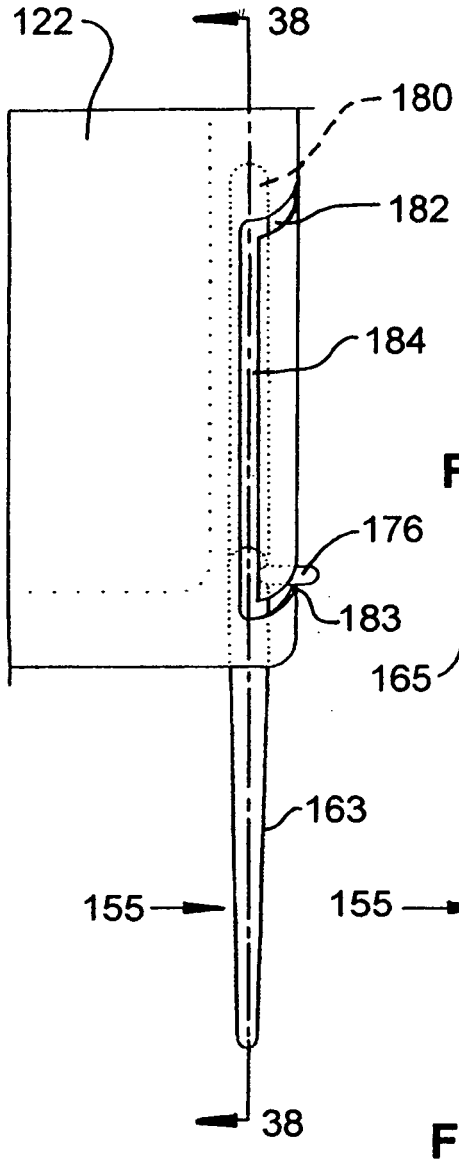
FIG. 33
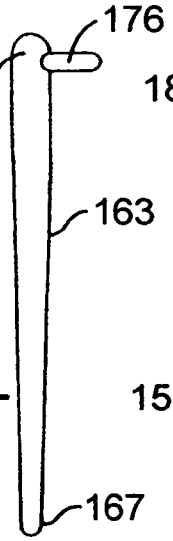
FIG. 36
FIG. 35
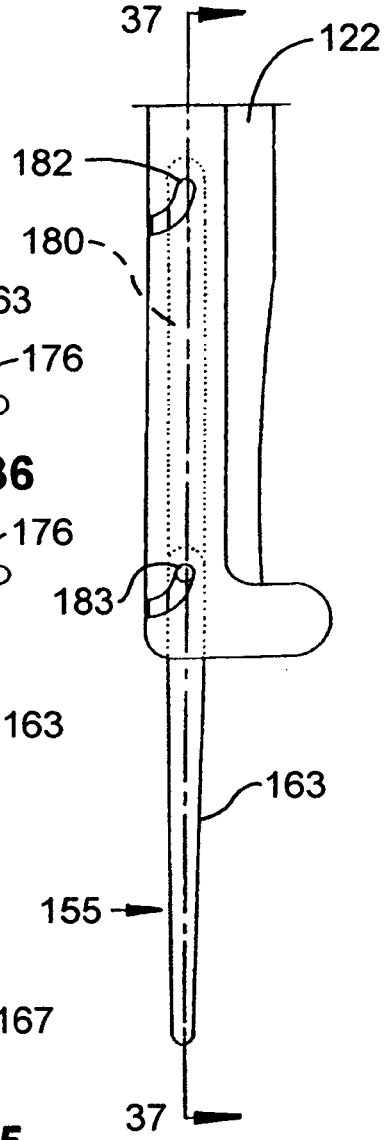
FIG. 34

CHAIR APPARATUS

CROSS REFERENCE TO RELATED APPLICATION

This Patent Application claims the benefit of U.S. Provisional Application No. 60/538,253, filed 20 Jan. 2004.

BACKGROUND OF THE INVENTION

1. Field of the Invention

This invention relates to a chair apparatus. More specifically, this invention relates to a chair apparatus having a backrest and at least one support member forming an element implantable into a ground surface, such as of sand or of dirt.

2. Discussion of Related Art

People that go to a beach often rest on either a conventional beach chair or a beach towel, to tan and/or to enjoy the views. A conventional beach chair, although adjustable to provide a desirable position and/or view, is typically heavy and bulky, and thus very inconvenient to carry to and at the beach. Instead of using a heavy and bulky beach chair many people rest upon a beach towel. A beach towel, although lightweight and easy to carry to and at the beach, offers no back support while sitting. Many people that sit on the sand and/or a towel place their hands on the ground surface behind their backs, to maintain their torsos in a lifted position. This position is uncomfortable.

There is a need for a chair apparatus that is lightweight, easy to carry and simple to use.

There is a need for a simple chair apparatus that can be used on a ground surface, such as a beach, to provide support.

SUMMARY OF THE INVENTION

It is one object of this invention to provide a chair that is lightweight, convenient to carry and structurally sound.

It is another object of this invention to provide a simple chair that requires either no or relatively little assembly.

It is yet another object of this invention to provide a chair suitable for use on a ground surface, such as a sand surface at a beach.

One further object of this invention can be to provide a chair having at least one engaging element for engaging various accessories, such as an umbrella, a shade, a mount and/or personal belongings, such as clothing, bags and/or cameras.

The above and/or other objects of this invention are accomplished with a chair apparatus having a backrest and at least one support member attached with respect to the backrest. Each support member preferably has a first end and a second end opposite the first end, where the first end is attached with respect to the backrest. Each support member extends away from the backrest and forms an implantable element, which is insertable into a ground surface, such as a sand surface and/or a dirt surface.

The backrest can be a solid plate, can be slotted and/or can have any number of open areas. In one preferred embodiment of this invention, the backrest is of a rail structure over which a flexible material can be attached or secured. The open areas preferably serve aesthetic and/or utility purposes. For example, in one embodiment of this invention, the backrest has an open slot that functions as a handle for carrying the chair apparatus. In another embodiment of this invention, the backrest has a second open slot that can function as a receptacle for a hook, to hang the chair apparatus on a wall or other support structure, for storage. In another embodiment of this invention, the backrest has a central cavity within which a foot or a tool can be placed, to insert at least one support member into the ground. The user can place a foot within the central cavity and use body weight to push the chair apparatus with a foot in a downward direction to insert the support member into the ground. The backrest can form a footrest or a contact surface for a pushing or an impact force exerted by a foot or other tool or object, for implanting the support member into the ground. Alternatively, the support member can have an exposed or extending contact surface upon which a force can be applied to insert the support member into the ground, for example by applying an impact or a driving force to the contact surface or otherwise to the backrest.

The backrest can be concave, convex and/or can have any other curvature to better accommodate or conform to a body. The backrest can have a variety of different shapes and sizes to accommodate different individuals and/or aesthetic preferences. The backrest can have sides that taper or run generally parallel, in a direction generally away from the support member. A protective cover can be used to cover the backrest.

Preferably, but not necessarily, the backrest has at least one engaging element for engaging various accessories, such as an umbrella, a shade, a mount and/or a personal belonging, such as clothing, a bag or a purse.

The chair apparatus according to this invention has at least one support member attached with respect to the backrest, forming an overall implantable element. In one embodiment of this invention, the chair apparatus has only one support member. In another embodiment of this invention, the chair apparatus has two support members. In another embodiment of this invention, the chair apparatus has three or more support members. A chair apparatus according to this invention may have any number of support members, individually or collectively forming one or more implantable elements.

Each support member can be molded with or within the backrest and/or can be a separate element. In one embodiment, the support member is removably attachable with respect to the backrest. In one embodiment of this invention, an end portion of the support member is threaded, and the support member is removably, threadably engageable with a correspondingly threaded portion of the backrest. In another embodiment of this invention, a portion of the backrest forms an interference fit with the support member, to removably attach the backrest to the support member. The backrest can have a storage cavity for storing the removable support member.

Preferably, the support member tapers or converges in a direction away from the backrest. A tapered or converged support member can be easier to implant in the ground. The chair apparatus can have a structural element reinforcing the support member, and the structural element may taper in the same direction as the support member. A detachable cover can be positioned over the support member.

In another embodiment, the support member is retractable within or into the backrest. The backrest can have a chamber or a cavity for retracting the support member and a channel designed to receive a guide element extending from the support member. The support member can be retracted by moving the guide element to a first position within the channel, and the support member can be extended by moving the guide element to a second position within the channel.

The support member can be an elongated element, such as a prong. Alternatively, the support element can form a blade or can have any other suitable shape and/or size.

BRIEF DESCRIPTION OF THE DRAWINGS

The preceding and the following description of embodiments is better understood when read in view of the following drawings, wherein:

FIG. 25 is a partial front view of a chair apparatus, showing a support member and a portion of a backrest, according to one embodiment of this invention;

FIG. 26 is a partial front view of a chair apparatus, showing a support member and a portion of a backrest, according to another embodiment of this invention;

FIG. 27 is a partial side view of the chair apparatus, as shown in FIG. 26;

FIG. 29 is a top view of the cover, as shown in FIG. 28;

FIG. 33 is a partial front view of a chair apparatus, showing a support member and a portion of a backrest, according to another embodiment of this invention;

FIG. 34 is a partial side view of the chair apparatus, as shown in FIG. 33;

FIG. 35 is a front view of a support member, as shown in FIG. 33;

FIG. 36 is a top view of the support member, as shown in FIG. 35;

It should be noted that the drawings are not necessarily to scale and that there may be other embodiments of this invention. The drawings are not intended to limit the scope of this invention.

DESCRIPTION OF PREFERRED EMBODIMENTS

With reference to FIGS. 1–49, various embodiments of chair apparatus 120 according to this invention are shown.

Chair apparatus 120 is preferably but not necessarily injection molded, including single molded, such as gas or water assisted injection molded or rotational molded. Although chair apparatus 120 may be standard injection molded, gas or water assisted injection molding or rotational molding can produce chair apparatus 120 that is structurally thick and lightweight. Chair apparatus 120 may be made of plastic, metal or any other suitable material known to those skilled in the art.

Figure 1:
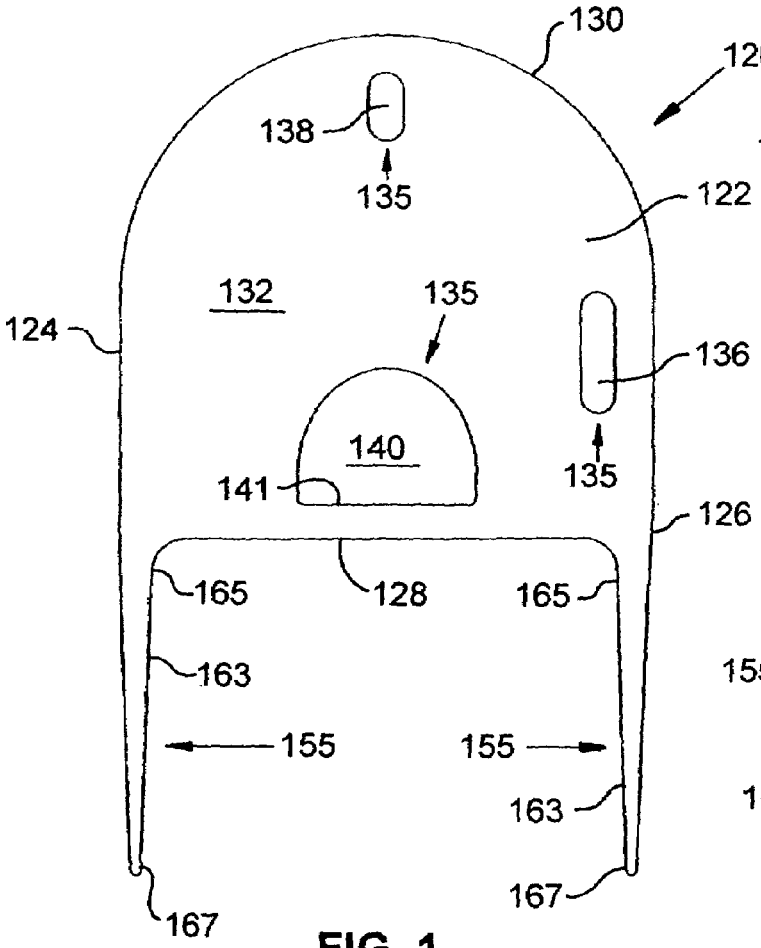
FIG. 1 is a front view of a chair apparatus, according to one embodiment of this invention.
Figure 22:
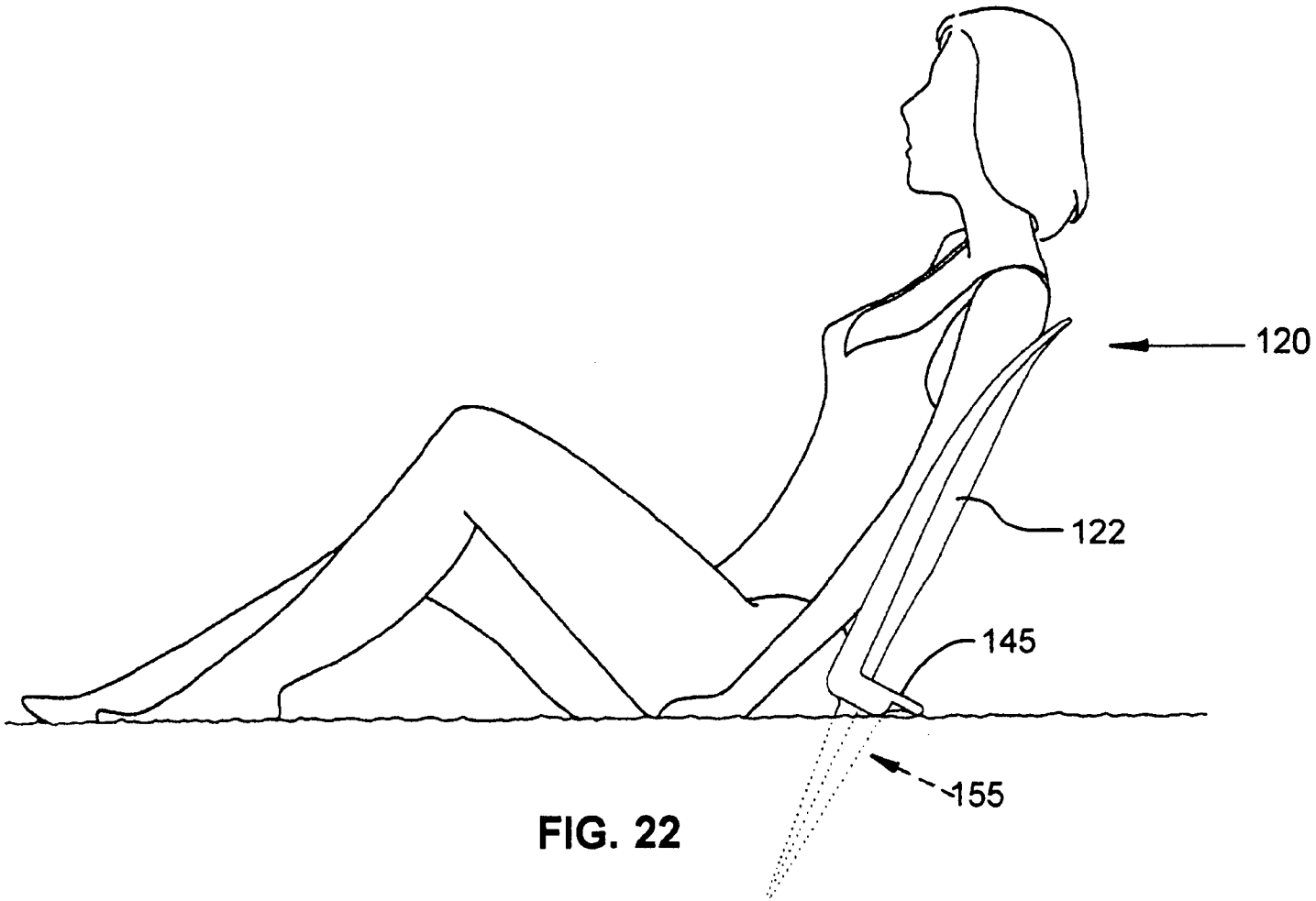
FIG. 22 is a side view showing a chair apparatus, similar to that as shown in FIG. 17, in use.
Figure 24:
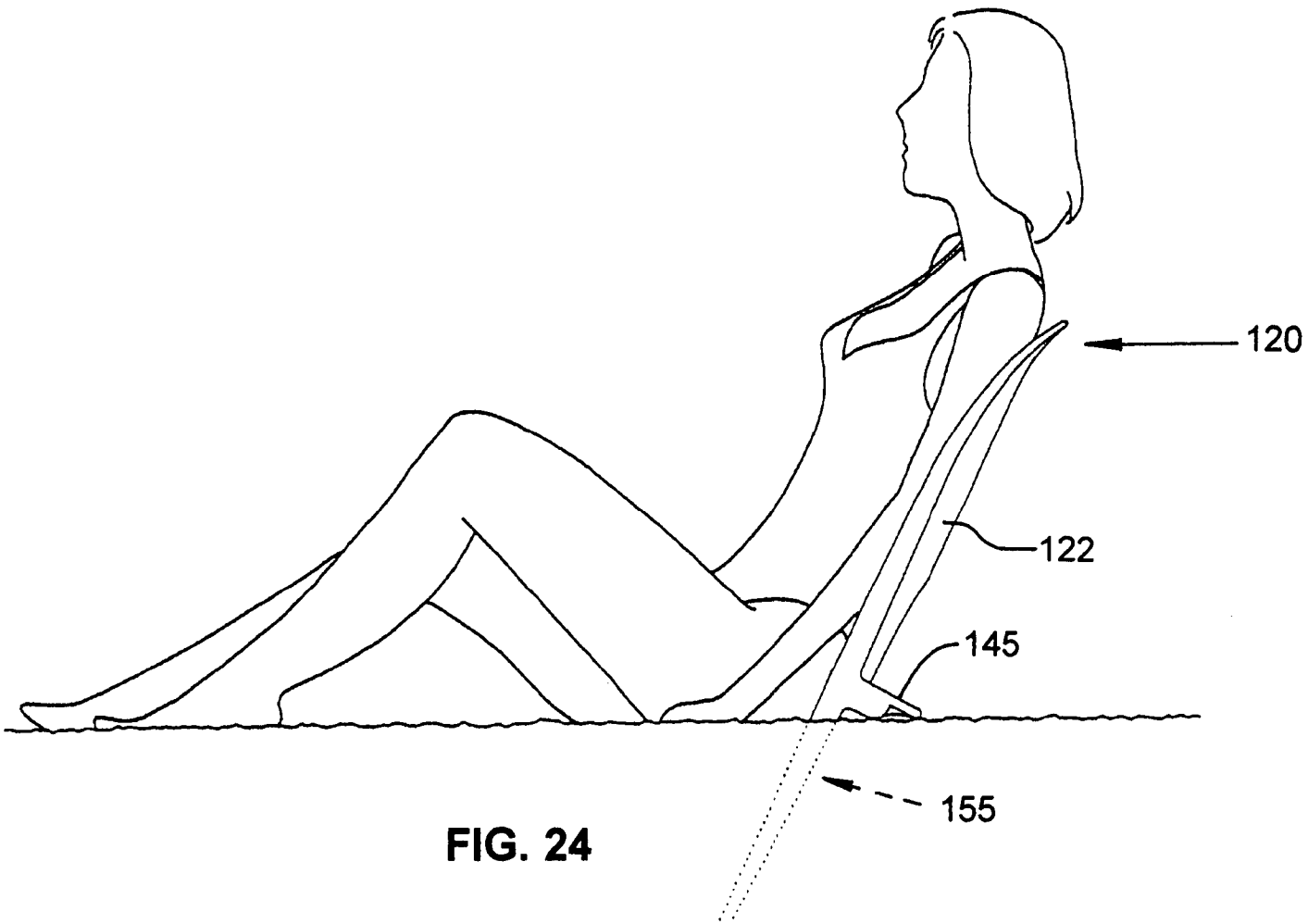
FIG. 24 is a side view of a chair apparatus, similar to that as shown in FIG. 2, showing the chair apparatus in use.

According to one embodiment of this invention, as shown in FIG. 1, chair apparatus 120 comprises backrest 122 and at least one support member 155 attached with respect to backrest 122. Each support member 155 preferably has end 165 attached with respect to backrest 122 and end 167 positioned opposite end 165. Support member 155 extends away from backrest 122 and forms an implantable element. When chair apparatus 120 is in use, support member 155 is implanted into a ground surface, for example as shown in FIGS. 22 and 24, such as sand or dirt, and backrest 122 which remains above the ground, provides support for the back of a user. Implanted support member 155 supports backrest 122 and maintains backrest 122 in a desired position with respect to the ground. FIGS. 22 and 24 illustrate use of chair apparatus 120 according to this invention.

Figure 3:
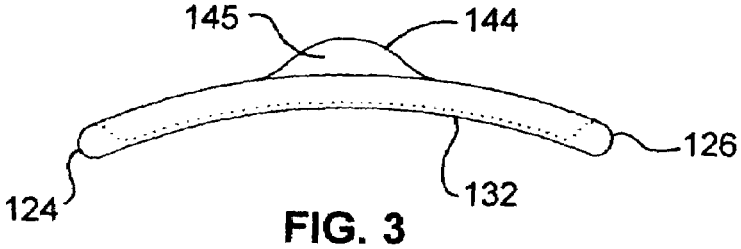
FIG. 3 is a top view of the chair apparatus, as shown in FIG. 1.

Referring generally to FIGS. 1 and 3, in one embodiment of this invention, backrest 122 preferably has side 124, side 126 opposite side 124, side 128 extending between side 124 and side 126, and side 130 opposite side 128. Side 132 is preferably bound by side 124, side 126, side 128 and side 130.

Figure 2:
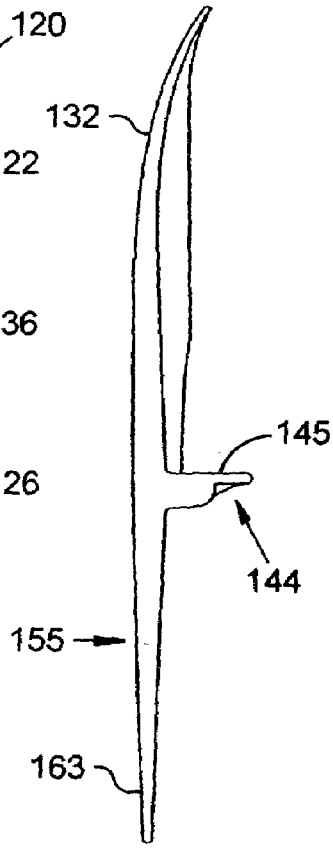
FIG. 2 is a side view of the chair apparatus, as shown in FIG. 1.
Figure 7:
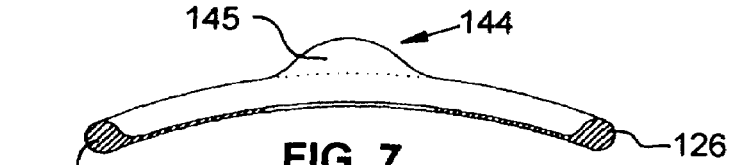
FIG. 7 is a sectional view of the chair apparatus, as shown in FIG. 4, taken along line 7—7.
Figure 6:
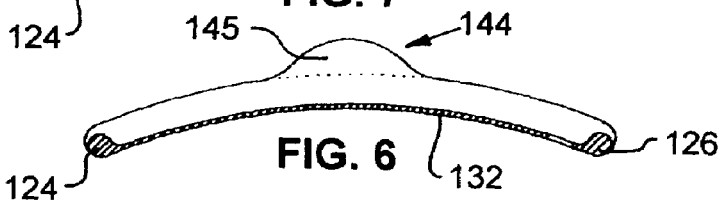
FIG. 6 is a sectional view of the chair apparatus, as shown in FIG. 4, taken along line 6—6.
Figure 4:
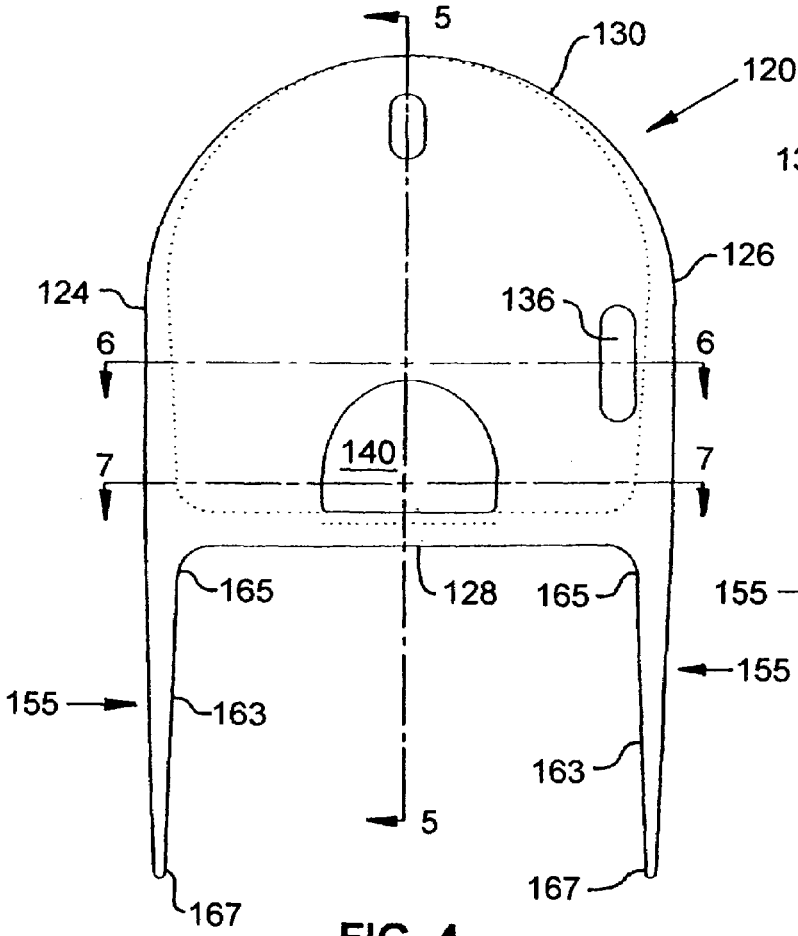
FIG. 4 is another front view of the chair apparatus, as shown in FIG. 1.
Figure 5:
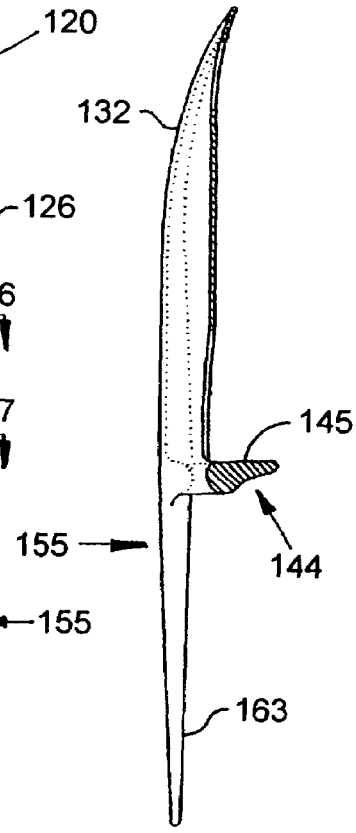
FIG. 5 is a sectional view of the chair apparatus, as shown in FIG. 4, taken along line 5—5.
Figure 9:
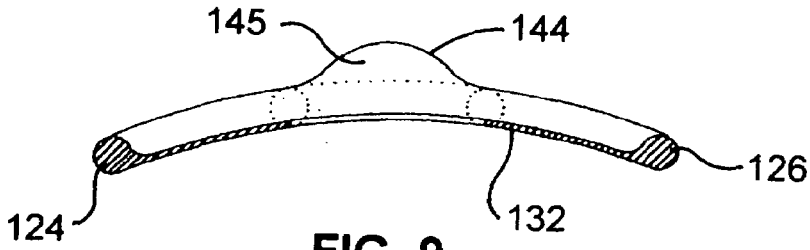
FIG. 9 is a sectional view of the chair apparatus, as shown in FIG. 8, taken along line 9—9.
Figure 8:
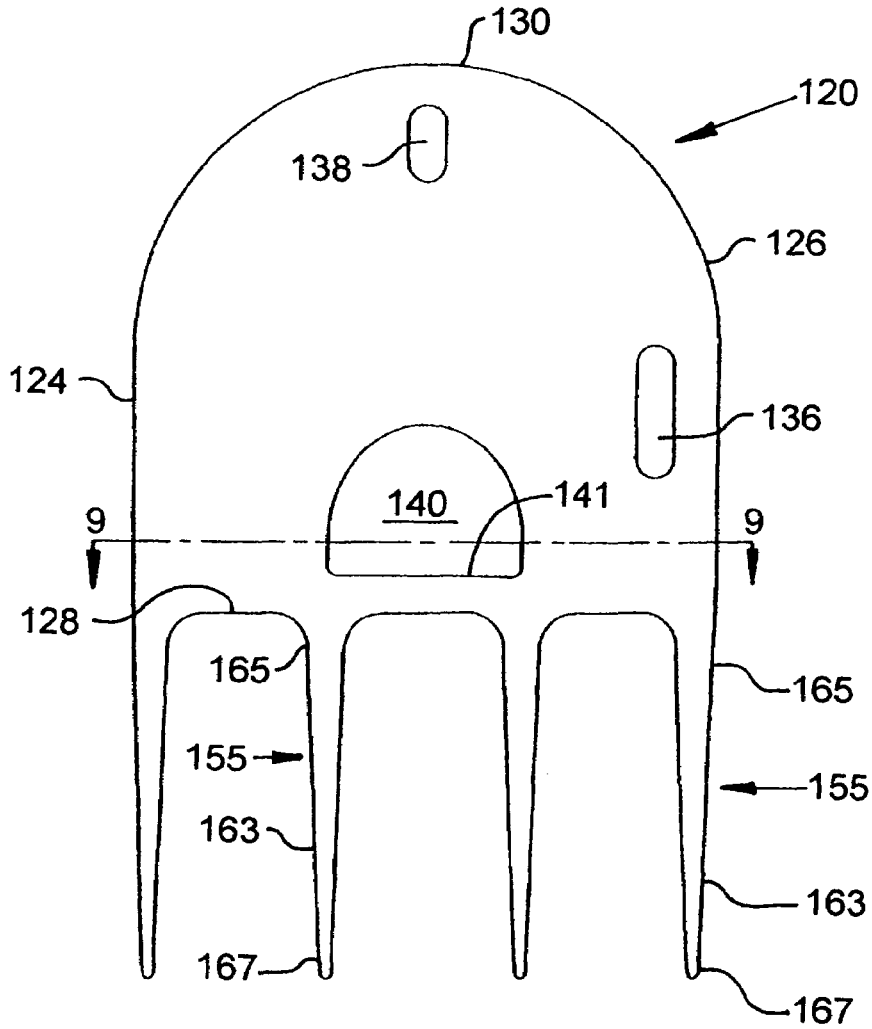
FIG. 8 is a front view of a chair apparatus, according to another embodiment of this invention.

According to one embodiment as shown in FIGS. 1 and 2, side 124 and side 126 taper in a direction away from side 128. Chair apparatus 120 may or may not have a consistent thickness in the area where backrest 122 meets support member 155.

Figure 11:
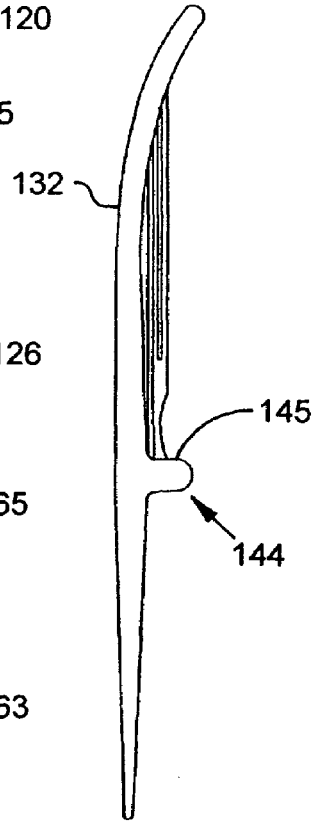
FIG. 11 is a side view of the chair apparatus, as shown in FIG. 10.
Figure 14:
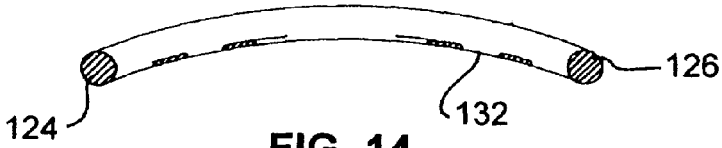
FIG. 14 is a sectional view of the chair apparatus, as shown in FIG. 12, taken along line 14—14.

As shown in FIGS. 3, 6, 7 and 9, backrest 122 may have concave front surface between side 124 and side 126, to better accommodate a contour of a back, arms and shoulders of a user. As shown in FIGS. 2 and 11, backrest 122 may have convex curvature in the direction from side 128 to side 130, to accommodate the contour of the back, arms and shoulder of the user, and if backrest 122 is extended in height or length will allow the user to tilt and rest its head on curved backrest 122, for example.

Backrest 122 can have any one of various lengths. In one embodiment of this invention, as shown in FIG. 22, a height of backrest 122 can be selected so that the upper position of backrest 122 terminates near a shoulder blade area of the user, but backrest 122 can also extend beyond the neck of the user. An extended backrest can provide support not only for the back, but also for the head. It is apparent to one skilled in the art that backrest 122 may be formed into a variety of desirable shapes and sizes to accommodate different preferences.

Figure 10:
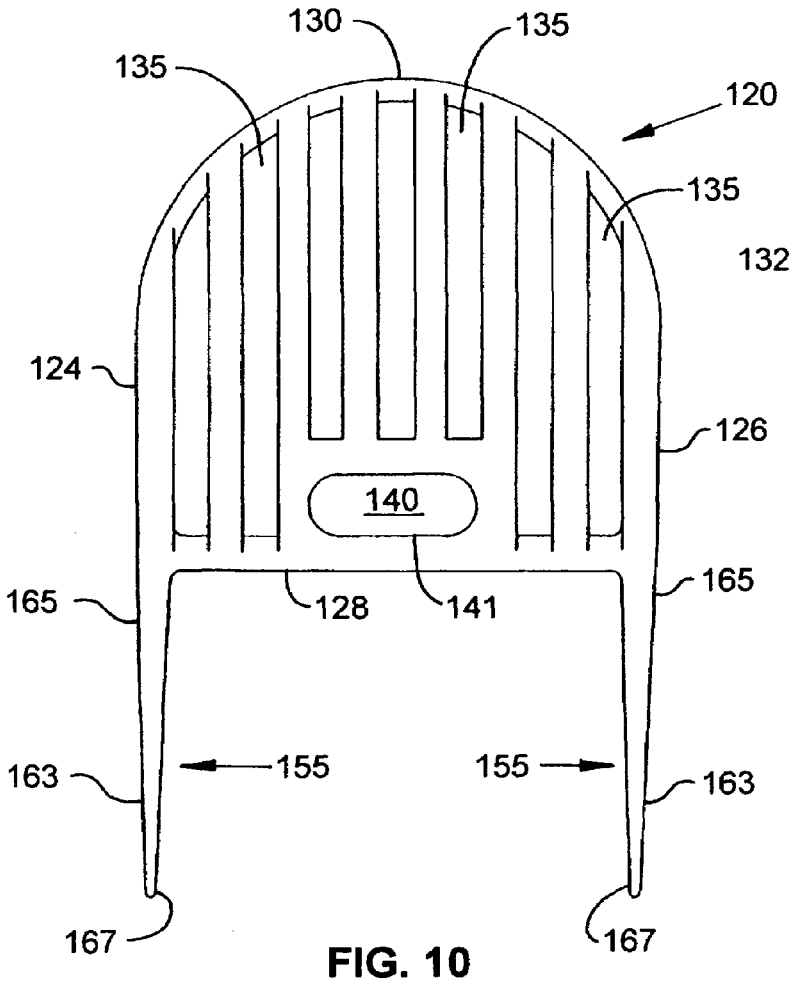
FIG. 10 is a front view of a chair apparatus, according to another embodiment of this invention.
Figure 12:
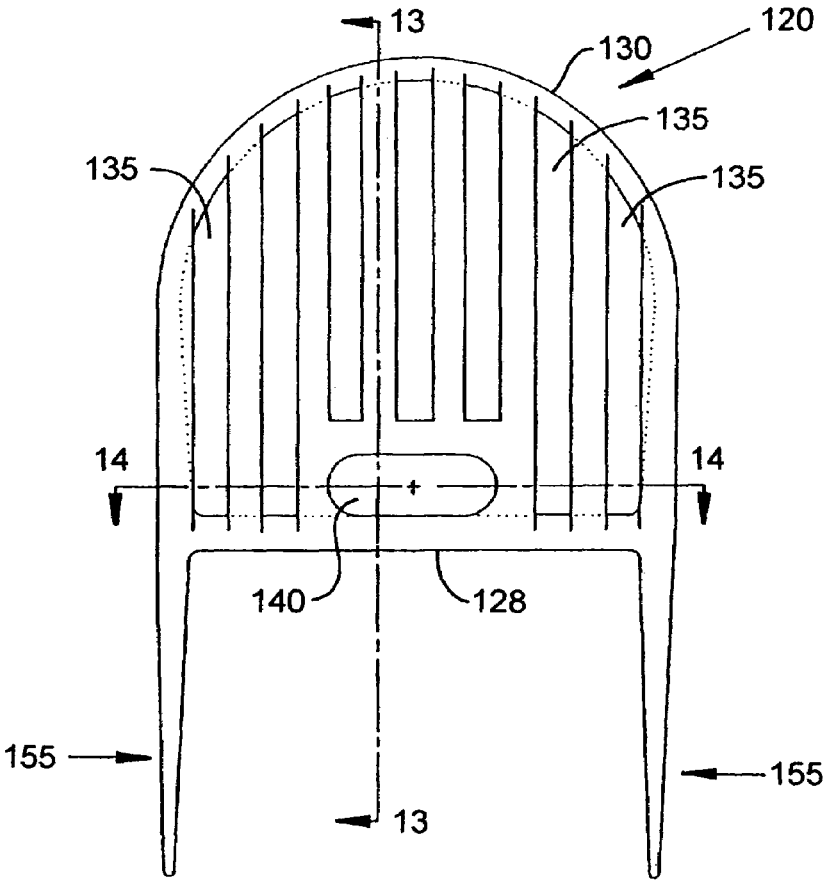
FIG. 12 is another front view of the chair apparatus, as shown in FIG. 10.
Figure 13:
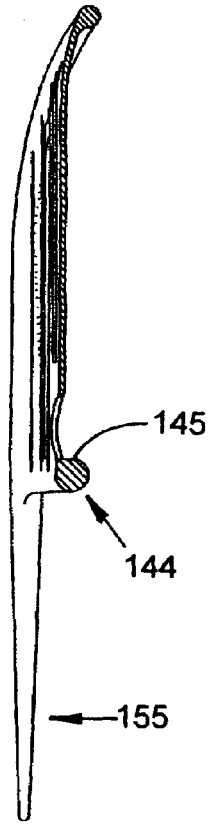
FIG. 13 is a sectional view of the chair apparatus, as shown in FIG. 12, taken along line 13—13.

Backrest 122 comprises at least one open area 135. Although this invention contemplates chair apparatus 120 having backrest 122 without any open areas 135, backrest 122 having open areas 135 may be beneficial for different reasons. For example, open areas 135 may provide aeration to the back of a user. Open areas 135 can also be used for conveniently carrying or storing chair apparatus 120, or for other purposes, such as to improve the aesthetic qualities or to reduce the material of chair apparatus 120. Backrest 122 can have more open areas 135, such as shown in FIGS. 10 and 12. Backrest 122 of this invention may contain any desired number of open areas 135 of any desired size or shape.

In one embodiment of this invention, as shown in FIG. 1, open slot 136 is positioned near side 126. Alternatively, open slot 136 may be positioned near side 124 of backrest 122. Open slot 136 is preferably used to carry chair apparatus 120 by positioning fingers or a hand through open slot 136, for obtaining a better grip. Open slot 136 may be positioned closer to side 126 and/or side 124 of backrest 122, to allow for a more comfortable grip. Open slot 136 can be positioned so that when chair apparatus 120 is carried horizontally, the weight of chair apparatus 120 is distributed approximately equally on both sides of open slot 136.

Figure 16:
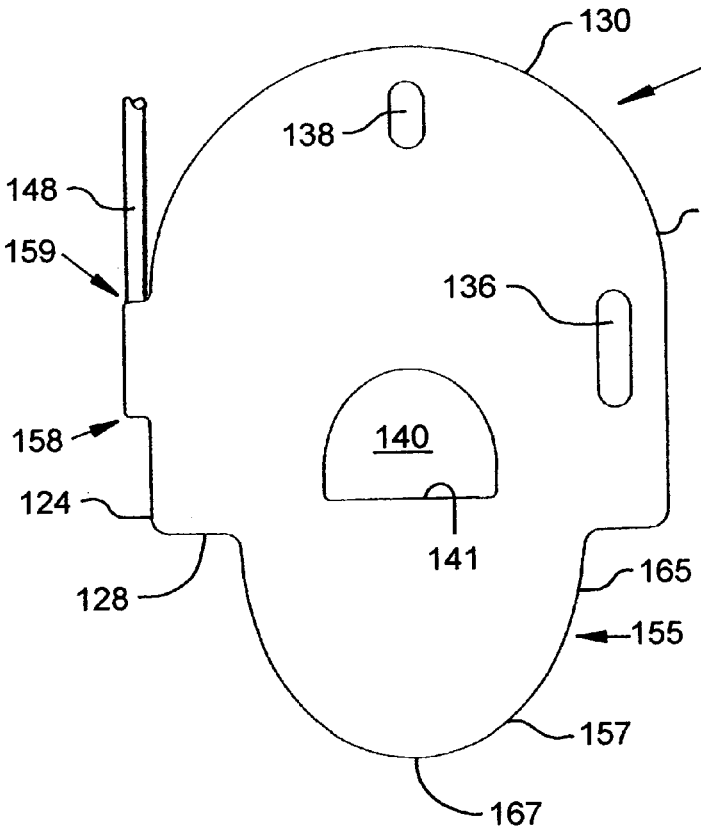
FIG. 16 is a front view of a chair apparatus, according to another embodiment of this invention.

In another embodiment of this invention, such as shown in FIG. 16, open area 135 is formed as open slot 138 that can accommodate a hook, or other hanging apparatus.

Figure 21:
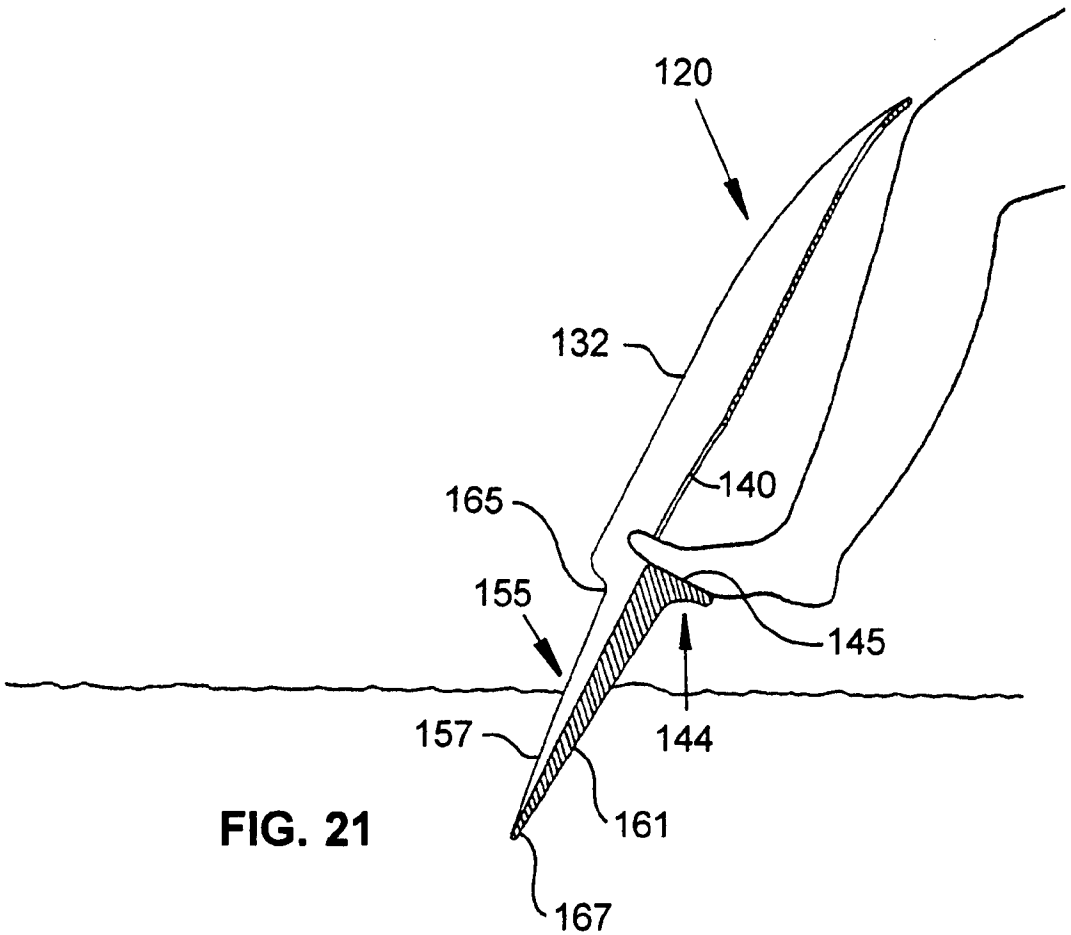
FIG. 21 is a sectional view, similar to the view in FIG. 19, of a chair apparatus, showing the chair apparatus being inserted into a ground surface, such as sand or dirt.
Figure 23:
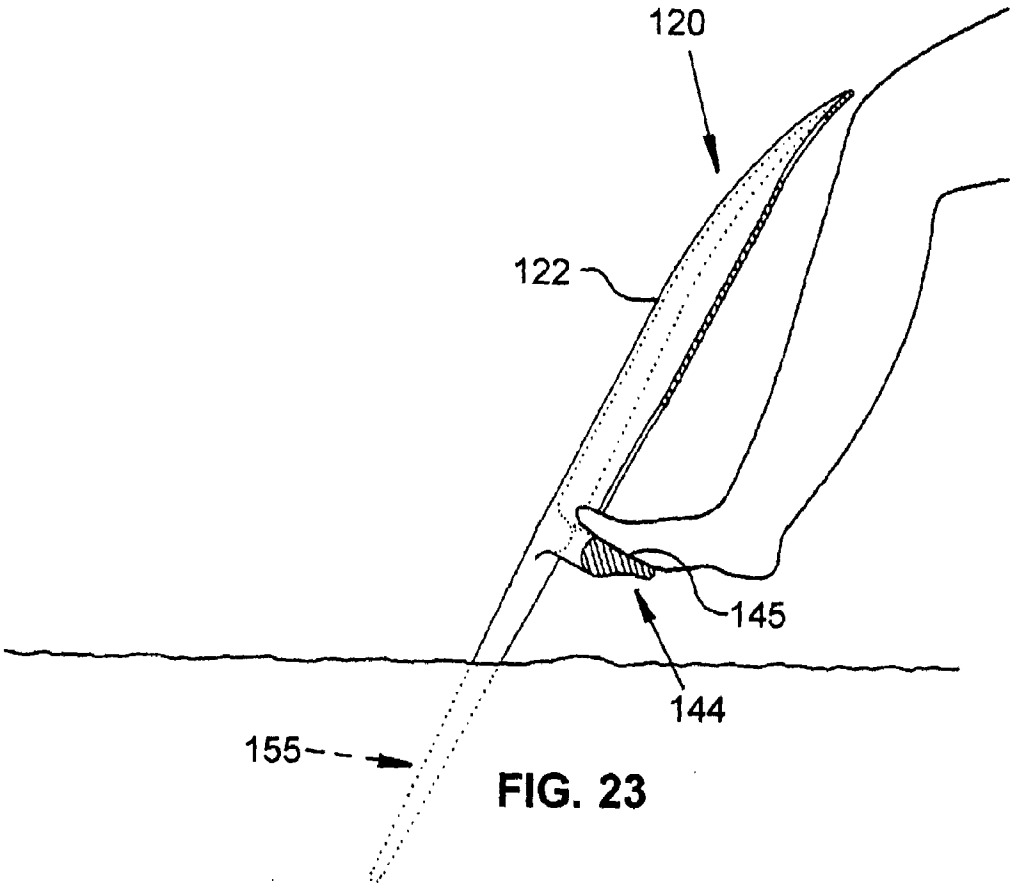
FIG. 23 is a sectional view, showing a chair apparatus, similar to that as shown in FIG. 5, being inserted into a ground surface, such as sand or dirt.

As shown in FIG. 1, for example, cavity 140 is preferably used to assist insertion of the at least one support member 155 of chair apparatus 120 into the ground or ground surface. Cavity 140 preferably accommodates at least a part of a foot, a tool or another suitable object. To insert support member 155 of chair apparatus 120 into the ground, an individual can position a foot on wall 141 of cavity 140 and make foot contact with wall 141 to apply a force or body weight, preferably in a downward direction. This operation can be similar to inserting a shovelhead of a shovel into the ground by stepping on the shovelhead. FIGS. 21 and 23 illustrate insertion of support member 155 into the ground.

In one embodiment of this invention, such as shown in FIG. 2, backrest 122 comprises footrest 144 which assists the insertion process described above by providing contact surface 145 for an impact force exerted by a foot or other tool or object to thrust chair apparatus 120 downward. Although footrest 144 may be used as an independent structure, in one embodiment of this invention, such as shown in FIG. 2, contact surface 145 of footrest 144 is substantially flush with or a continuation of wall 141. Footrest 144 can have any suitable shape and size. As shown in FIGS. 2 and 3, for example, footrest 144 and thus contact surface 145 extend outward from backrest 122 and thus form an enlarged surface for a foot or other tool.

Figure 15:
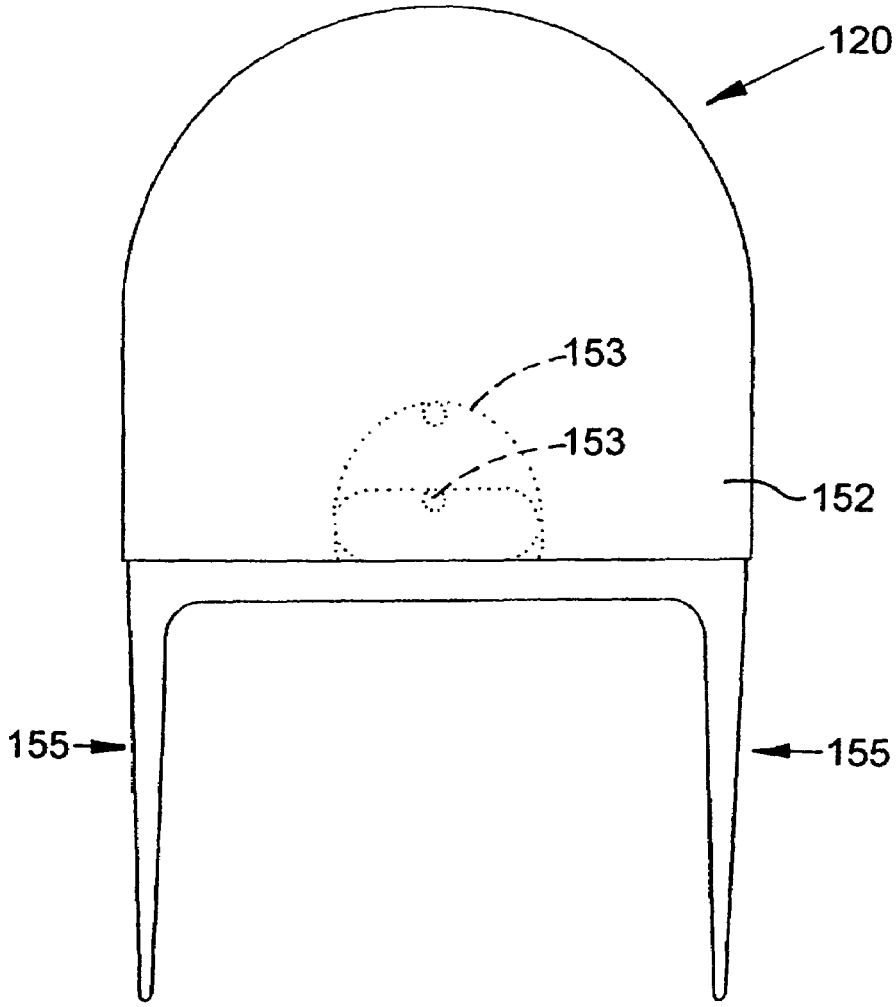
FIG. 15 is a front view of a chair apparatus, according to another embodiment of this invention, with a cover over the backrest.

Backrest 122 may have a variety of different forms to support the back of a user. For example, in one embodiment of this invention, backrest 122 can be a solid or hollow structure, such as a panel. In another preferred embodiment, such as shown in FIG. 10, backrest 122 is vertically slotted. Backrest 122 may also be horizontally slotted, or slotted at another desired angle. In yet another embodiment of this invention, backrest 122 can be formed by a U-shaped bar structure or frame, such as shown in FIG. 15, beneath cover 152, with the legs of the U-shape being formed by supporting members 155. As shown in FIG. 15, a flexible material can form cover 152 which can be slipped over or otherwise attached to backrest 122.

Preferably, but not necessarily, backrest 122 further comprises at least one engaging element 158 for engaging various accessories, such as an umbrella, a shade and/or a mount for objects including personal belongings, such as clothing or bags. In one embodiment of this invention, such as shown in FIG. 16, engaging element 158 is formed as holder 159. Engaging element 158 can also be formed as a hook or another suitable hanging or support structure.

Holder 159 can be formed as a pocket or a pouch molded into backrest 120 or can be a separate structure attached to backrest 122 by any attachment device or method known to those skilled in the art. Holder 159 is preferably designed to accommodate shafts 148 of various accessories, such as an umbrella, a shade device and/or a mount for personal belongings. Holder 159 can also be designed to hold other objects, including, but not limited to, cups or bottles. An umbrella can have a flexible or positionable shaft to adjust the umbrella to a desired position. Holder 159 can be positioned within or attached to a surface of backrest 122.

Holder 159 can be molded within or attached to any part of backrest 122, but holder 159 preferably is not attached to a portion of backrest 122 that contacts a back of a user when chair apparatus 120 is in use.

A hook can be molded into backrest 122 or the hook can be a separate structure attached to backrest 122 with any suitable connection or method known to those skilled in the art. The hook can be used to hang various items.

Figure 43:
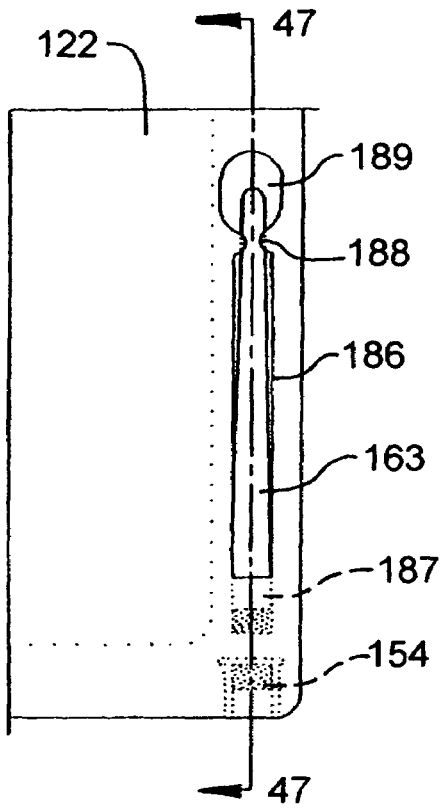
FIG. 43 is a front view of a chair apparatus, according to another embodiment of this invention, showing a removable support member stored within a storage cavity of the backrest.
Figure 44:
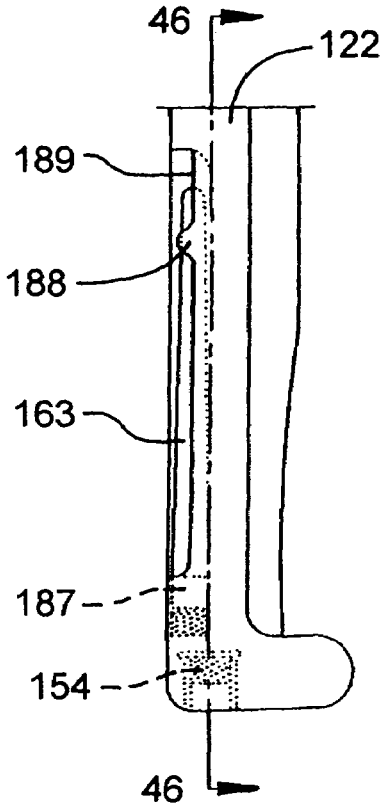
FIG. 44 is a side view of the chair apparatus, as shown in FIG. 43.
Figure 45:
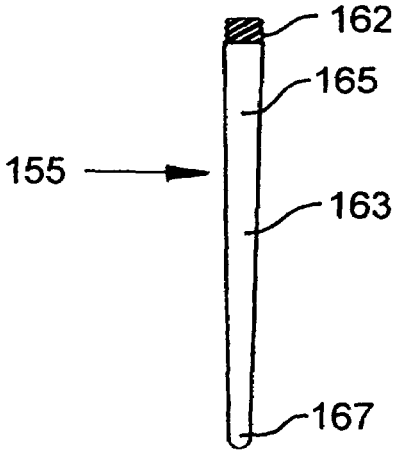
FIG. 45 is a front view of a removable support member.
Figure 46:
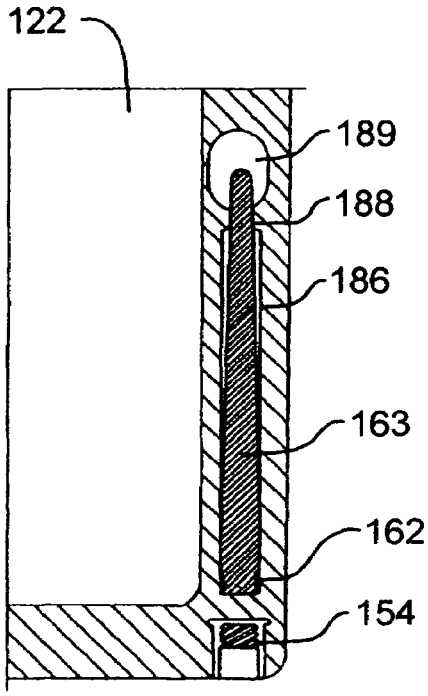
FIG. 46 is a partial sectional view of the chair apparatus, as shown in FIG. 44, taken along line 46—46.
Figure 47:
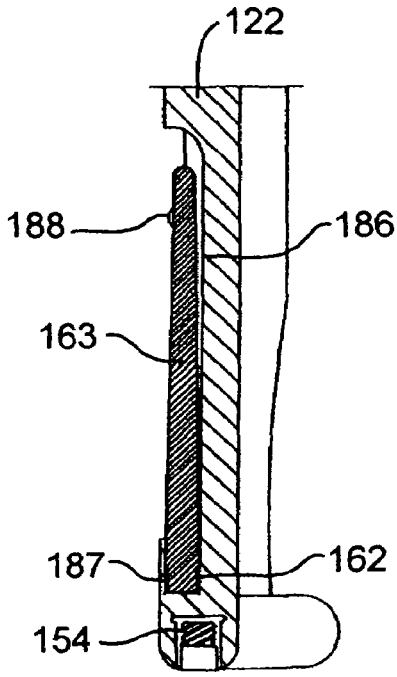
FIG. 47 is a partial sectional view of the chair apparatus, as shown in FIG. 43, taken along line 47—47.
Figure 48:
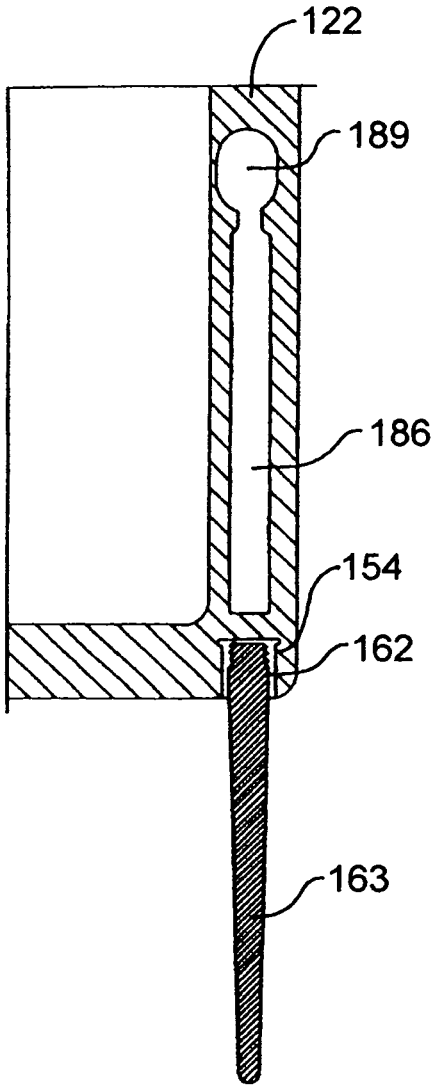
FIG. 48 is a partial sectional view of the chair apparatus, as shown in FIG. 46, but showing the removable support member in an attached and extended position.
Figure 49:
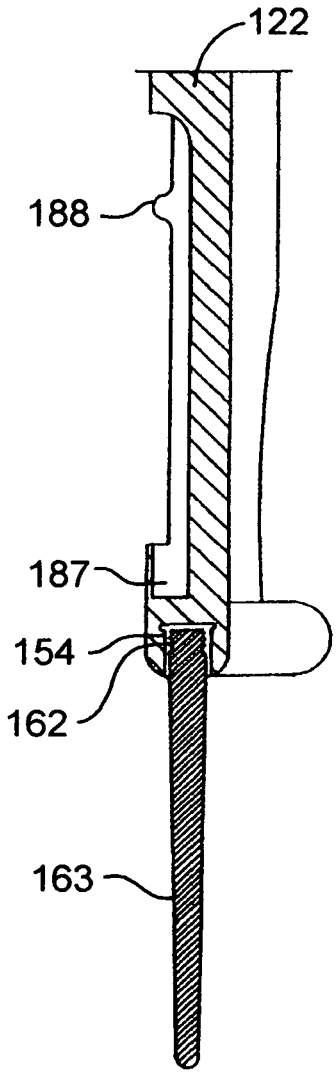
FIG. 49 is a partial sectional view of the chair apparatus, as shown in FIG. 47, but showing the removable support member in an attached and extended position.

Backrest 122 may further comprise storage cavity 186. In one embodiment of this invention, as shown in FIGS. 43 and 44–49, storage cavity 186 houses detachable support member 155. Storage cavity 186 can have receiver 187 and/or fastener 188. Receiver 187 accepts end 165 of support member 155, and fastener 188 can secure support member 155 within storage cavity 186. As shown in FIG. 43, end portion 189 of storage cavity 186 can be enlarged, for example so that a finger or a utensil can be inserted to easily grasp and remove support member 155 from storage cavity 186. FIGS. 43 and 44 show cavity 186 open or exposed to the front of backrest 122 and in other embodiments of this invention, cavity 186 can be open or exposed to the side, the rear and/or the front.

As shown in FIGS. 43–47, detachable support member 155 has threaded portion 162 at end 165 that can engage with internal threads 154 within a receiver formed by backrest 122. Any other suitable mechanical connection can be used to detachably connect support member 155 with respect to backrest 122.

In one embodiment of this invention, as shown in FIG. 15, cover 152 can fit over backrest 122 and at least partially cover backrest 122. As shown in FIG. 15, backrest cover 152 may comprise at least one fastener 153 to secure backrest cover 152 around backrest 122 using any open areas, but preferably cavity 140.

Figure 17:
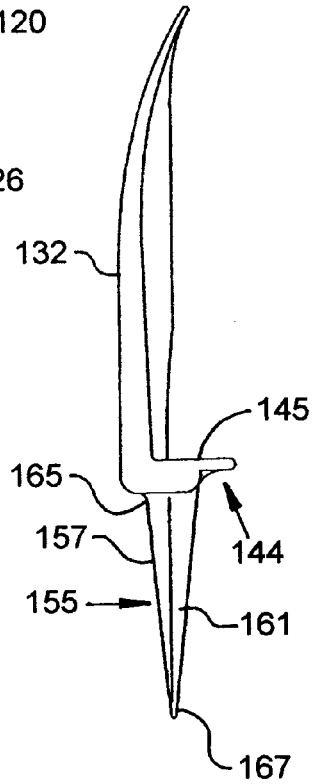
FIG. 17 is a side view of the chair apparatus, as shown in FIG. 16.
Figure 20:
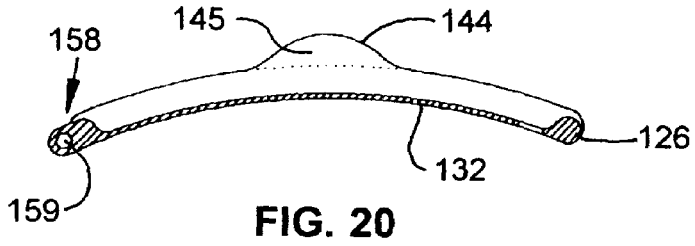
FIG. 20 is a sectional view of the chair apparatus, as shown in FIG. 18, taken along line 20—20.
Figure 18:
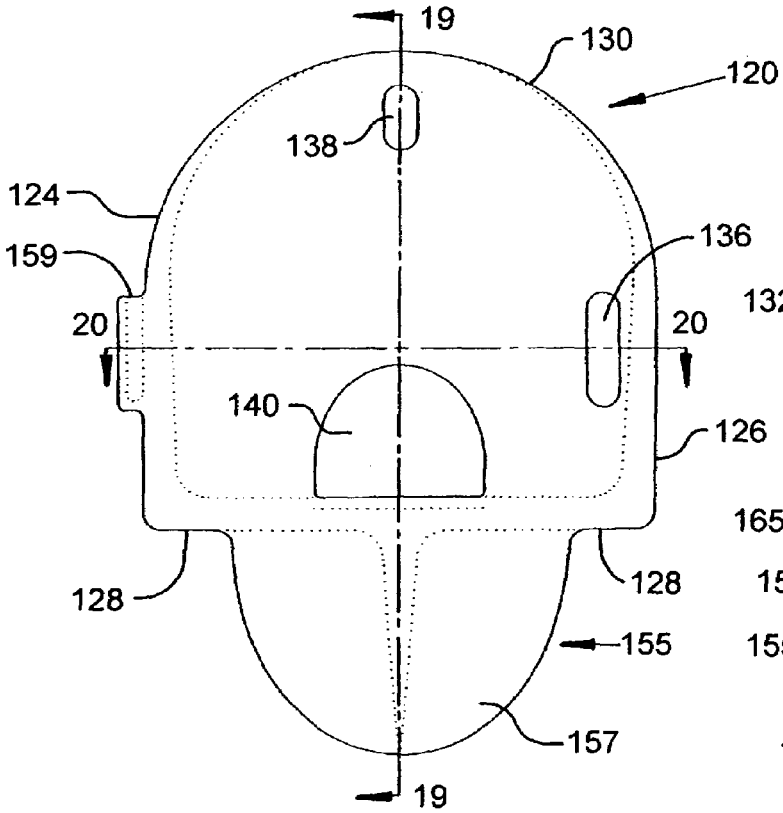
FIG. 18 is another front view of the chair apparatus, similar to that as shown in FIG. 16.

Implantable support member 155 is attached with respect to backrest 122, and can have a form of prong 163, blade 157 or any other suitable shape. FIG. 17 illustrates support member 155 as forming blade 157 that can add stability to chair apparatus 120. The same or a similar result may be achieved with chair apparatus 120 having support member 155 formed by using more than one prong 163 and/or by arranging one or more prongs 163 at or near the critical area. In other embodiments, the front surface of blade 157 can merge into side 132, for example to form a clean transition between backrest 122 and support member 155.

Support member 155 extends away from backrest 122 with end 165 preferably adjacent to backrest 122 and end 167 preferably away from backrest 122. During insertion of support member 155 into the ground surface, the ground or other similar surface or structure, end 167 preferably enters first. Support member 155 can taper from end 165 toward end 167, for example as shown in FIGS. 1 and 2. A tapered support member 155 can be easier to implant. Such tapering can also allow support member 155 to retain its thickness near the critical area.

As shown in FIGS. 1 and 2, support member 155 extends in a direction substantially parallel to side 132 of backrest 122, so that support member 155 continues in the same direction as side 132 of backrest 122. Alternatively, support member 155 can be substantially parallel to side 124 and/or side 126. In other embodiments of this invention, such as shown in FIG. 2, support member 155 may be an extension of backrest 122. Preferably, but not necessarily, backrest 122 and each support member 155 have a substantially similar thickness adjoining the area where the at least one support member 155 is attached to backrest 122, such as shown in FIG. 2.

Support member 155 can have an exposed contact surface that can be used during insertion of support member 155 into the ground or other similar surface or structure as a contact area for a foot or other tool or object used to force or thrust chair apparatus 120 downward. The exposed contact surface can be used in a similar fashion as contact surface 145 of an extended footrest 144.

Figure 19:
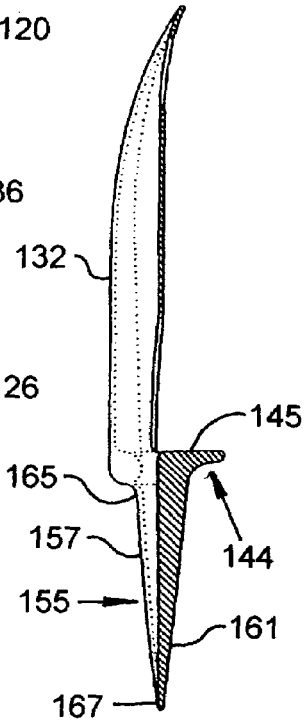
FIG. 19 is a sectional view of the chair apparatus, as shown in FIG. 18, taken along line 19—19.

Chair apparatus 120 according to this invention may further comprise at least one structural element 161, as shown in FIGS. 17 and 19, to reinforce support member 155. As shown in FIG. 19, structural element 161 can extend between footrest 144 and end 167 of support member 155. Structural element 161 can also taper toward end 167 of support member 155.

Support member 155 can be at least partially positioned within backrest 122. FIG. 25 shows support member 155 at least partially molded within a portion of backrest 122. Such positioning creates an interference fit between backrest 122 and support member 155. In one embodiment of this invention, as shown in FIG. 25, support member 155 is formed as prong 163 having central axis 171 and external surface 172. Circumference 164 can be greater than second circumference 166, as shown in FIG. 25. In one embodiment of this invention, as shown in FIG. 25, prong 163 comprises at least one recess 169 formed within external surface 172. As shown in FIG. 25, recess 169 may be an inner groove 168 formed within that portion of surface 172 which is positioned within backrest 122. Inner groove 168 preferably increases the resistance of an interference fit between support member 155 and backrest 122. As shown in FIG. 25, groove 169 can be but need not be substantially perpendicular to central axis 171 of prong 163.

Figure 28:
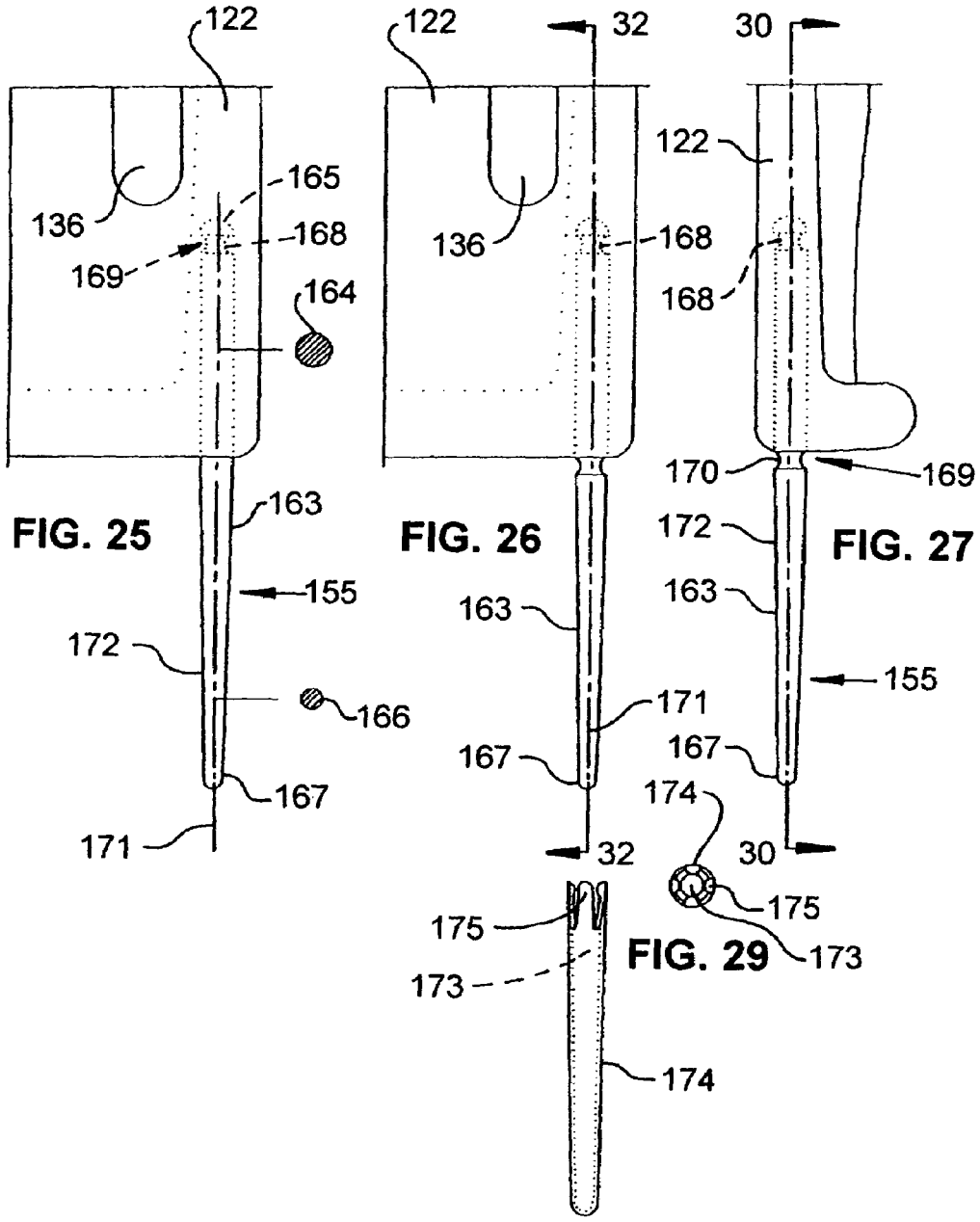
FIG. 28 is a front view of a cover for a support member.
Figure 30:
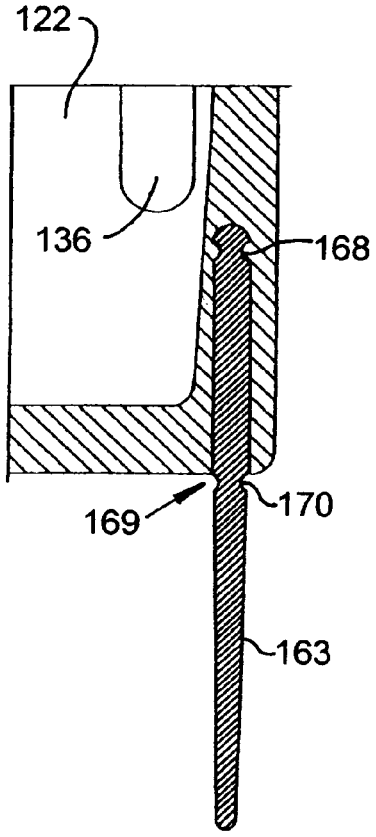
FIG. 30 is a partial sectional view of the chair apparatus, as shown in FIG. 27, taken along line 30—30.
Figure 31:
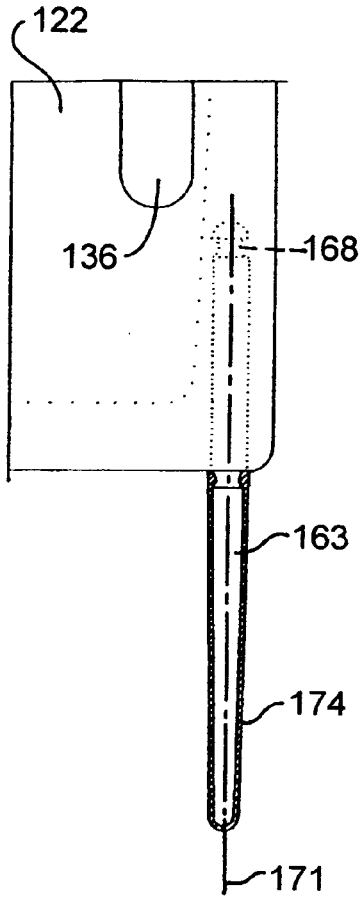
FIG. 31 is a partial sectional view of the chair apparatus, as shown in FIG. 26, but showing the cover in a cross section.
Figure 32:
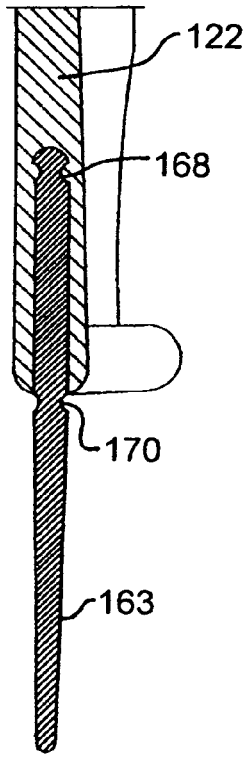
FIG. 32 is a sectional view of the chair apparatus, as shown in FIG. 26, taken along line 32—32.
Figure 37:
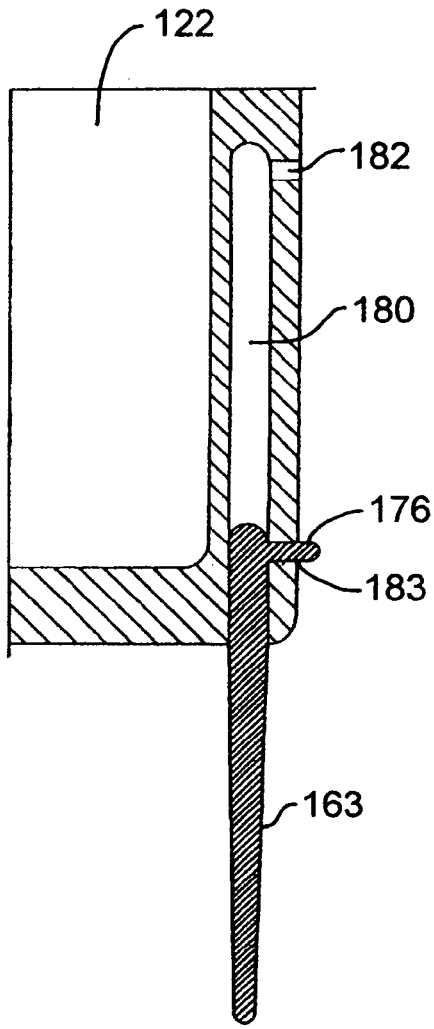
FIG. 37 is a partial sectional view of the chair apparatus, as shown in FIG. 34, taken along line 37—37, showing the support member in an extended and locked position.
Figure 38:
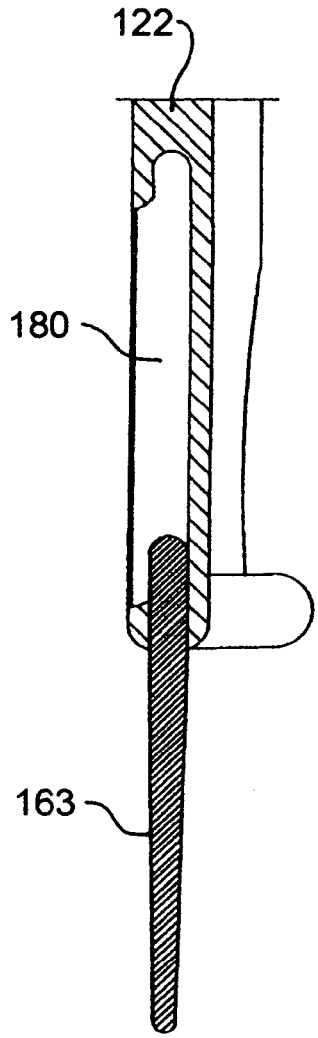
FIG. 38 is a partial sectional view of the chair apparatus, as shown in FIG. 33, taken along line 38—38, showing the support member in an extended and locked position.

Referring generally to FIGS. 28 and 29, support member 155 may further comprise cover 174 detachably connected to support member 155. In one embodiment of this invention, such as shown in FIG. 28, cover 174 comprises cover opening 173 into which support member 155 is insertable and a plurality of fasteners 175, such as fingers or grips, arranged around a perimeter of cover opening 173. Fasteners 175 are preferably fittingly insertable into groove 170 to secure cover 174 to support member 155. Cover 174 can be made of any suitable material and may be securable to support member 155 by any connection or attachment known to those skilled in the art.

Figure 39:
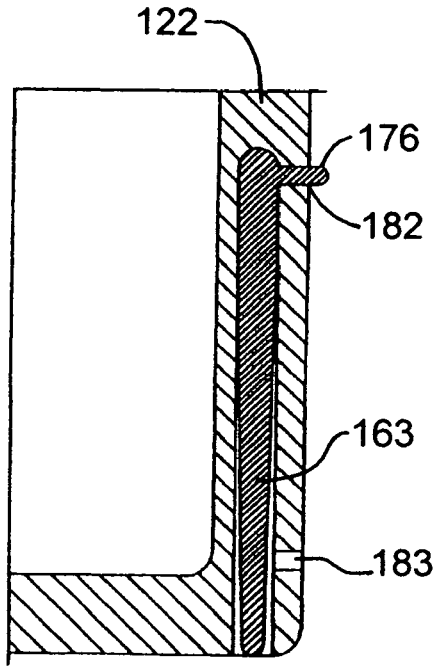
FIG. 39 is a partial sectional view of the chair apparatus, as shown in FIG. 37, but showing the support member in a retracted position.
Figure 40:
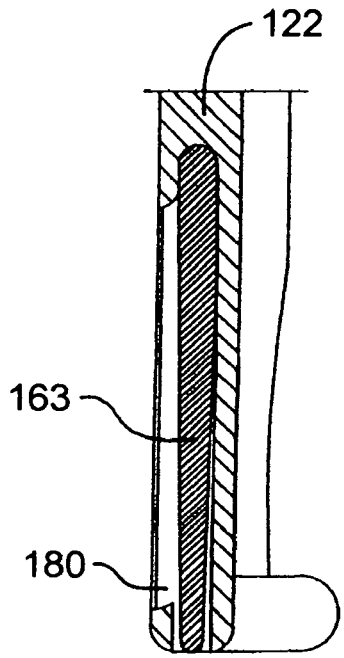
FIG. 40 is a sectional view of the chair apparatus, as shown in FIG. 38, but showing the support member in a retracted position.
Figure 42:
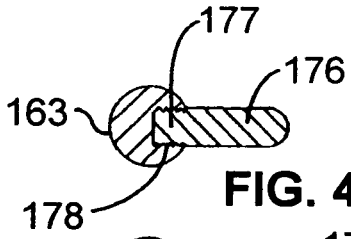
FIG. 42 is an enlarged top partial sectional view of the support member, as shown in FIG. 41.
Figure 41:
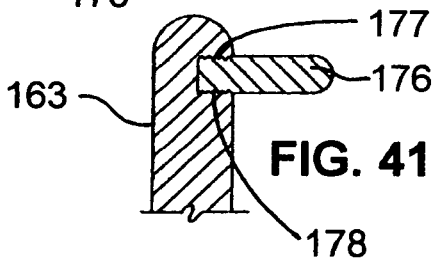
FIG. 41 is an enlarged front partial sectional view of the support member, as shown in FIG. 35.

In one preferred embodiment of this invention, as shown in FIGS. 33, 34 and 37–40, support member 155 is retractably attached with respect to backrest 122. Preferably, support member 155 comprises guide 176 extending from support member 155, such as shown in FIGS. 35 and 36. Guide 176 may be an extension of support member 155 or, alternatively, guide 176 maybe a separate structure, as shown in FIG. 41. Guide 176 can have threaded end 177, which is threadably engageable with corresponding threaded aperture 178 within support member 155, as shown in FIG. 41. Referring to FIG. 40, backrest 122 preferably forms at least one cavity 180 for receiving support member 155, such as when support member 155 is retracted into backrest 122.

As shown in FIG. 33, backrest 122 further forms channel 184 for receiving guide 176 extending from support member 155. Guide 176 preferably rides or travels in channel 184 between channel end 182 and channel end 183. When support member 155 is in a retracted position, as shown in FIG. 39, support member 155 is preferably within cavity 180, and guide 176 is preferably at or near channel end 182. When support member is in an extended position, as shown in FIG. 33, guide 176 is preferably at or near channel end 183. To either retract or extend support member 155, guide 176 should be moved through channel 184 to either channel end 182 or channel end 183, respectively. Preferably, but not necessarily, as shown in FIG. 33, channel end 182 and channel end 183 are at an angle with respect to channel 180. Such orientation prevents support member 155 from self-retracting or self-extending.

While in the foregoing specification this invention has been described in relation to certain preferred embodiments, and many details have been set forth for the purpose of illustration, it will be apparent to those skilled in the art that the invention is susceptible to additional embodiments, and that certain of the details described can be varied considerably without departing from the basic principles of the invention.

What is claimed is:

1. A chair apparatus, comprising:

a backrest, a plurality of support members each having a first end portion and a second end portion opposite the first end portion, the first end portion attached with respect to the backrest, each of the support members extending away from the backrest and forming an implantable element, an outer periphery of the backrest forming a structure with a U-shape, the support members forming legs of the U-shape at the outer periphery, the backrest and each of the support members having a substantially similar thickness at an adjoining area, a wall of the backrest forming a cavity through the backrest, a footrest extending outward from the backrest, the wall of the cavity forming an enlarged surface of the footrest for accommodating a foot used to apply a force to the enlarged surface, and the backrest and the support members molded together.

2. The chair apparatus according to claim 1, wherein the backrest has a concave curvature.

3. The chair apparatus according to claim 1, wherein each of the support members tapers from the first end portion toward the second end portion.

4. The chair apparatus according to claim 1, wherein the backrest has at least one open area.

5. The chair apparatus according to claim 1, wherein the footrest extends away from the backrest in a rearward direction.

6. The chair apparatus according to claim 1, further comprising at least one structural element reinforcing the support members.

7. The chair apparatus according to claim 1, further comprising at least one cover detachably connected to at least one of the support members.

8. The chair apparatus according to claim 7, wherein the at least one cover has an opening and one of the support members is insertable in the opening.

9. The chair apparatus according to claim 1, further comprising a cover at least partially covering the backrest.

10. The chair apparatus according to claim 1, wherein each of the support members is retractable within the backrest.

11. The chair apparatus according to claim 1, wherein a guide element extends away from each of the support members, the backrest forms a channel, and the guide element rides in the channel between a first channel end portion and a second channel end portion.

12. The chair apparatus according to claim 1, wherein a portion of the backrest forms an interference fit with each of the support members.

13. The chair apparatus according to claim 1, wherein the backrest has a storage cavity.

14. The chair apparatus according to claim 1, wherein an end portion of each of the support members is threaded.

15. The chair apparatus according to claim 1, wherein at least one of the support members forms a blade.

16. The chair apparatus according to claim 1, wherein each of the support members has an exposed contact surface.

17. The chair apparatus according to claim 1, wherein the backrest further comprises at least one engaging element accommodating an accessory.

18. The chair apparatus according to claim 17, further comprising at least one accessory engaged with the at least one engaging element.

19. The chair apparatus according to claim 1, wherein the backrest is slotted.

20. The chair apparatus according to claim 1, wherein the backrest forms a rail.

* * * * *